US010258123B1

(12) United States Patent
Cunningham

(10) Patent No.: US 10,258,123 B1
(45) Date of Patent: Apr. 16, 2019

(54) HOLDER AND METHOD FOR HOLDING A PERSONAL COMPUTING DEVICE

(71) Applicant: Kelly W. Cunningham, Los Angeles, CA (US)

(72) Inventor: Kelly W. Cunningham, Los Angeles, CA (US)

( * ) Notice: Subject to any disclaimer, the term of this patent is extended or adjusted under 35 U.S.C. 154(b) by 0 days.

(21) Appl. No.: 15/627,401

(22) Filed: Jun. 19, 2017

Related U.S. Application Data

(60) Continuation of application No. 15/227,944, filed on Aug. 3, 2016, now Pat. No. 9,763,505, which is a continuation-in-part of application No. 29/546,519, filed on Nov. 23, 2015, now Pat. No. Des. 805,021, which is a division of application No. 29/529,975, filed on Jun. 11, 2015, now Pat. No. Des. 805,020.

(60) Provisional application No. 62/273,386, filed on Dec. 30, 2015.

(51) Int. Cl.
*A45C 11/00* (2006.01)
*A45C 13/00* (2006.01)

(52) U.S. Cl.
CPC ..... *A45C 11/00* (2013.01); *A45C 13/001* (2013.01); *A45C 2011/002* (2013.01); *A45C 2011/003* (2013.01); *A45F 2200/0516* (2013.01)

(58) Field of Classification Search
CPC ..... A45F 2005/008; A45F 2200/0508; A45F 2200/0516; A45F 2200/0525; A45C 2011/001–2011/003; A45C 11/00; H04B 1/3888; H04B 2001/3861; Y10S 224/93; B43K 23/004; B43K 23/008
USPC ..... 224/217, 251, 930; 401/8; 294/25; D3/215, 218; D14/427
See application file for complete search history.

(56) References Cited

U.S. PATENT DOCUMENTS 1,006,367 A * 10/1911 Dittmar ..... A61F 13/105 2/21
5,357,680 A * 10/1994 Monistere ..... B26B 21/525 30/298
8,783,533 B1 * 7/2014 Marseille ..... H04B 1/385 224/197
8,818,465 B1 * 8/2014 Gorham, Jr. ..... H04M 1/04 455/575.1
2009/0270050 A1 * 10/2009 Brown ..... A45F 5/00 455/90.3
2011/0290975 A1 * 12/2011 Lin ..... F16M 11/28 248/346.04
2012/0031937 A1 * 2/2012 Baker ..... A45C 11/00 224/217
2012/0305445 A1 * 12/2012 Hu ..... A45C 11/00 206/775

(Continued)

*Primary Examiner* — Scott T McNurlen
(74) *Attorney, Agent, or Firm* — Cislo & Thomas, LLP

(57) ABSTRACT

A holder for a personal computing device (PCD) and method for allowing a user of a PCD to securely hold the PCD with a single finger; to selectively position his or her thumb horizontally, vertically, angularly, and a desired distance away from the PCD, when holding the PCD to more easily reach any point on the touchscreen with the thumb on his same hand without ever needing to resort to using his other hand; and allowing the user, in the alternative, to rest the PCD on a flat surface, such as to read articles or watch videos, and prop the PCD up at a multitude of angles, in both landscape and portrait orientations depending on whether the flat surface is high or low and whether the user is sitting or standing.

14 Claims, 3 Drawing Sheets

(56) References Cited

U.S. PATENT DOCUMENTS

| | | | | |
|---|---|---|---|---|
| 2014/0077515 | A1* | 3/2014 | Rasmussen | A45F 5/00 294/169 |
| 2014/0097306 | A1* | 4/2014 | Hale | F16M 13/022 248/122.1 |
| 2015/0054297 | A1* | 2/2015 | Schaffer | A45F 5/00 294/137 |
| 2015/0084356 | A1* | 3/2015 | Dinh | F16M 13/00 294/25 |
| 2015/0372705 | A1* | 12/2015 | Fiorentino | H04M 1/04 455/575.6 |

* cited by examiner

HOLDER AND METHOD FOR HOLDING A PERSONAL COMPUTING DEVICE

CROSS-REFERENCES TO RELATED APPLICATIONS

This patent application is a continuation of U.S. patent application Ser. No. 15/227,944 filed Aug. 3, 2016, which is a continuation-in-part of U.S. Design patent application No. 29/546,519, filed on Nov. 23, 2015, which is a divisional of U.S. Design patent application No. 29/529,975, filed on Jun. 11, 2015; and this application also claims the benefit of U.S. Provisional Application No. 62/273,386, filed on Dec. 30, 2015. All such applications are incorporated herein by this reference thereto.

BACKGROUND OF THE INVENTION

The present invention relates to devices that can be used for both holding a personal computing device (PCD) in one's hand and propping up the PCD when placed on a flat surface.

SUMMARY OF THE INVENTION

One embodiment of the present invention comprises a PCD holder device utilizing a method of allowing a user of a PCD, such as a smartphone, computer tablet, mini-tablet, phablet, etc., to securely hold the PCD with a single finger when holding it and prop up the PCD when resting it on a flat surface. Some embodiments allow the user, when holding the PCD, to selectively position his or her thumb horizontally and vertically with respect to the touchscreen surface of the PCD, as well as angularly in relation to the touchscreen surface of the PCD. Some embodiments also allow the user to select the distance away from the PCD's touchscreen surface, all to more easily access with one's thumb any point on the touchscreen surface and to more easily input text using a keyboard region of the touchscreen surface, such as to email, text, or surf the web without the user ever needing to resort to his or her other hand.

Some embodiments allow the user, when resting the PCD on a flat surface, such as to read articles or watch videos, to select a multitude of angles, in both landscape and portrait orientations, at which to prop up the PCD. This could allow the user to view the screen of the PCD whether the flat surface is high or low and whether the user is sitting or standing.

Still other embodiments allow the user to securely hold the PCD in one hand so as to facilitate use of the finger or fingers of the other hand, or a stylus or other similar indicating device held in the other hand to select options on and input information through the touchscreen portion of the PCD.

BRIEF DESCRIPTION OF THE DRAWINGS

FIG. 3 is a cross-sectional view of one embodiment of the present invention in which first and second finger-receiving recesses 400, 500 have a slight constriction or tapering 440 in the medial portions 424 between.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
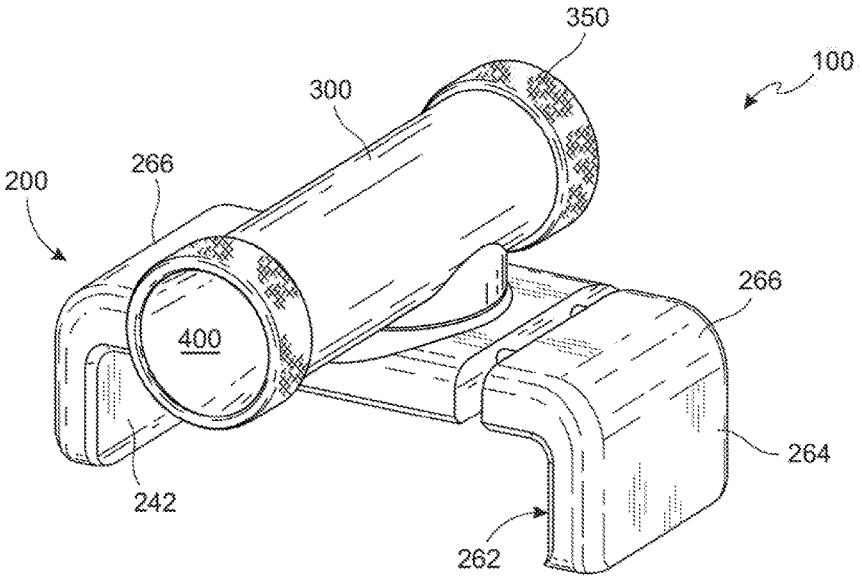
FIG. 1 is a perspective view of one embodiment of a PCD holder in keeping with the present invention.

FIG. 1 shows one embodiment of the present invention. This embodiment includes a holder 100 for a personal computing device (PCD) that comprises a mounting mechanism 200, and a body member 300 that is rigid and is rotatably connected to the mounting mechanism 200. In the embodiment shown in FIG. 1, the body member has a first finger-receiving recess 400. This recess is generally cylindrical with a diameter D1 sized to receive a portion of a human finger. The fit is preferably snug, securely holding the finger in a press-fit fashion. The opening of the recess may have a slight inwardly protruding lip 422 (shown in FIG. 4) so that one of the knuckles of the user's finger can be used to securely retain the holder 100 and thereby hold and control the PCD without risking the rest of the finger getting stuck due to friction with the surface(s) 520 of the recess 400.

Figure 2:
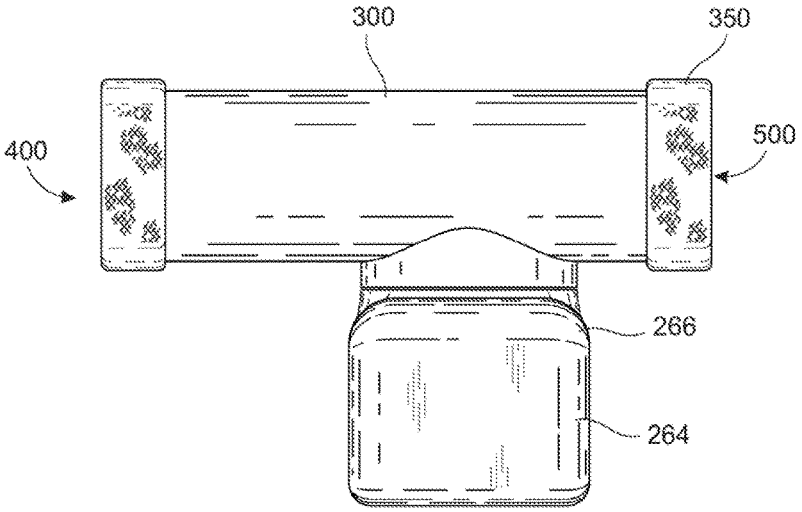
FIG. 2 is a side view of the embodiment in FIG. 1 showing tactile regions 350 on opposite ends of a body member 300.
Figure 3:
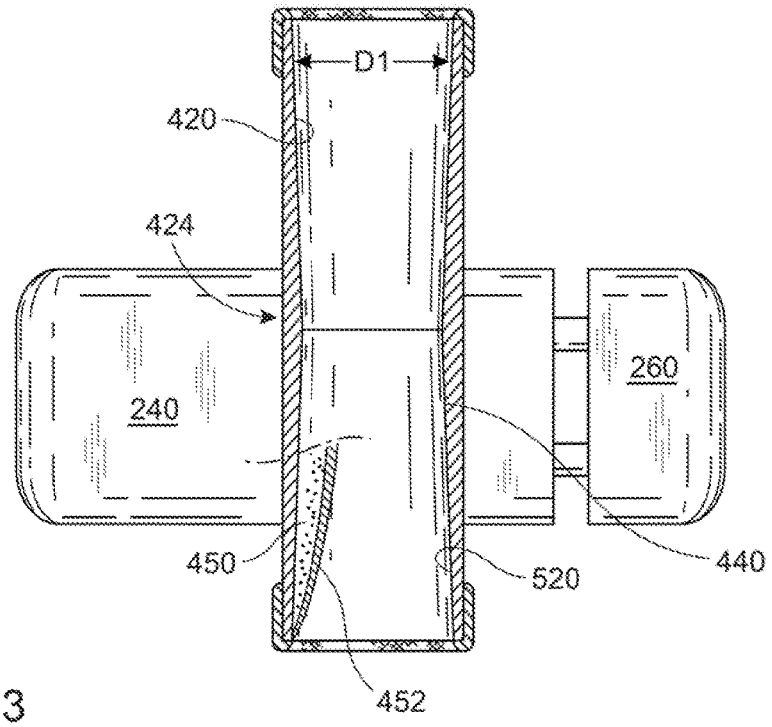
Figure 4:
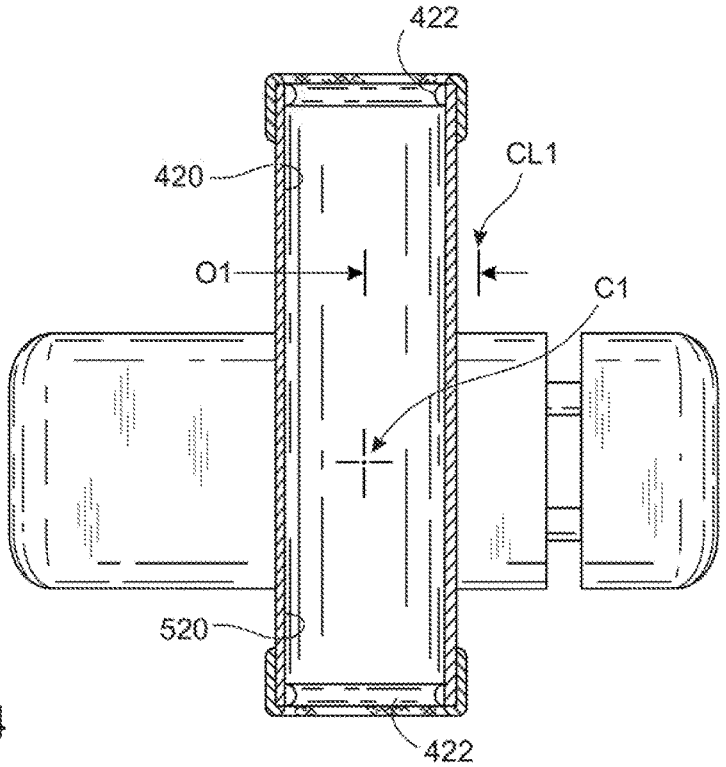
FIG. 4 is a cross-sectional view of another embodiment of the present invention in which first and second finger-receiving recesses 400, 500 each have a slight inward protruding lip.

As shown in FIGS. 2 through 4, there may be a second finger-receiving recess 500 as well. In one embodiment, the second finger-receiving recess 500 points in the opposite direction of the first finger-receiving recess 400, and it may be shorter than the first finger-receiving recess 400. Since the body 300 is fully rotatable, 360 degrees, these two recesses 400, 500 provide the user with twice the number of available hand—and thereby thumb—positions. The second finger-receiving recess 500 also could comprise a second diameter D2 (not shown), different than the first, so that the user could use a different finger with this second finger-receiving recess 500 than the first finger-receiving recess 400 and still feel roughly the same snugness with this different finger as when the user's preferred finger is in the first finger-receiving recess 400. Or this second finger-receiving recess 500 could comprise, together with the first finger-receiving recess 400, a single generally cylindrical recess, as is shown in FIGS. 3 and 4.

The first and second finger-receiving recesses 400, 500 may also have padding 450 along the recess walls 520.

Furthermore, the padding 450 could be covered with a breathable surface 452 material to add to this comfortable fit so that the user's finger will be comfortable in the recess(es) for even long periods of time. Also, the padding 450 and surface 452 could be advantageously configured to impose a very consistent compressive force over a large range of compression. In this way, the padding 450 and surface 452 could make a single recess diameter D1 feel comfortably snug for a large variety of finger widths and diameters, with both large and small fingers encountering approximately the same compressive forces when inserted into the finger-receiving recess, such as, for example, when the padding 450 comprises air, gel, or other lightly compressive material, and the surface 452 is a heavy material, such as leather or the like. Alternatively, the cushion could be an elastomeric material or some other stuffing, and the breathable surface could be cotton cloth or the like.

On the outside of the rotatable body member 300, there may be one or more outward facing support surfaces 320. The purposes of the outward facing support surfaces 320 include supporting the body member 300, and thereby the PCD, when the user rests the body member 300 on a desk, table, countertop, or other generally flat surface.

By being between the outward facing support surface 320 and the PCD, the body member 300 causes the PCD to rest on the generally flat surface at an angle between 10 degrees to 80 degrees from the flat surface, and more preferably, between 25 degrees and 65 degrees. That is, when the outward support surface 320 is set on a flat surface, the PCD rests at a noticeable angle away from the flat surface, which is often convenient and preferable to users, such as when watching a video, operating the touch sensitive surface of the PCD, or communicating with another person through the PCD. The outward facing support surface 320 may also have one or more tactile regions 350 to make the holder 100 resistant to sliding around when resting it and the PCD on the generally flat surface.

Figure 5:
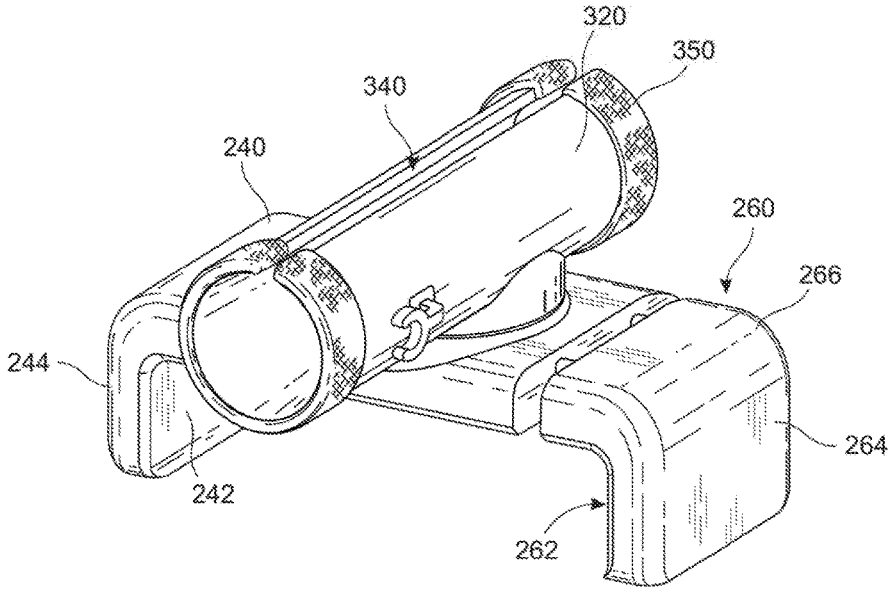
FIG. 5 is a perspective view of another embodiment of a PCD holder in keeping with the present invention in which the outer surface 320 of the body member 300 has a lengthwise slit 340 as one way to make the first and second finger-receiving recesses 400, 500 expandable to accommodate fingers of several different diameters.

In some embodiments, the body 300 also has a recessed region 600 for holding and retaining one or more accessories so that accessories, such as a Bluetooth earpiece, may be removably retained by the holder 100 between those times when the user wishes to use the accessory(ies). Also, or alternatively, the body member 300 has a connection region for the purpose of removably connecting the body member 300 to an external structure (not shown), such as a louvre of an air vent, a credit card or the like. FIG. 5 illustrates just one such connection region, in this case, a slit 340 extending the length of the body 300. Alternatively, the connection structure could be in the form of a snap or other clip mechanism for attaching to a key ring, or a mating mechanism formed on or into a briefcase, belt, or other article of clothing.

The mounting mechanism 200 can selectively grip and hold onto a PCD, usually, depending on the PCD, at many different points. It can do so nearly anywhere the PCD has two parallel edges. As a result, the user may selectively and removably mount the holder 100 to the PCD at a desired location, and, since the body 300 is rotatable, the user may selectively orient the body 300 so that a desired finger-receiving recess can be directed in a desired angular orientation (when the user wishes to hold the PCD with a finger) or so that the outward facing surface 320 of the body 300 can be directed in a desired angular orientation (when the user wishes to prop up the PCD on a generally flat surface).

That is, in some embodiments, the fact that the mounting mechanism 200 may mount to the PCD at many points, to be chosen by the user, that the body 300 is rotatably connected to the mounting mechanism 200, that this rotatable connection is offset by the distance of O1 (as shown in FIG. 4) to one side or the other of the centerline CL1 of the PCD when the holder 100 is mounted to the PCD, and that the second finger-receiving recess 500 is shorter than the first finger-receiving recess 400, the user has nearly an unlimited number of ways to laterally position and then angularly orient one or the other finger-receiving recess to precisely the position needed or desired to optimize the holding of the PCD, whether it is for reaching and manipulating any point on the touchscreen surface of the PCD, comfortable holding the PCD in a way that frees up the user's other hand and even the user's other fingers and thumb of the same hand by which he or she is holding the PCD.

Add to this the fact that the body 300 is configured not only to allow the user to hold the PCD with a single finger when desired, but also to allow the user to prop up the PCD on a generally flat surface when desired, these above-mentioned degrees of movement and positioning afford for the user a great number of choices for propping up the PCD, as well as orienting the PCD in either landscape or profile. In this way, the tactile surface 350 on the outward facing support surface 320 of the rigid body member 300, in combination with a selected one of the tactile regions 266 on the first and second outward facing support surfaces 244, 264 form a bipod or tripod base for resting the PCD on a flat surface in the desired propped up angle.

Since the mounting mechanism 200 is removably mountable to the PCD, it may also be flipped over, and thereby reversible, and mounted to the PCD in a manner that swaps where the longer and shorter finger-receiving recesses 400, 500, respectively, are so as to provide the user with twice the number of positions for the holder 100.

The mounting mechanism 200 shown in FIG. 1 has two opposing inward facing surfaces 242 and 262, a biasing means or mechanism 250 for biasing the two opposing inward facing surfaces 242, 262 toward one another, and second outward facing support surfaces 266 in communication with either of these two opposing inward facing surfaces. In this embodiment shown, the biasing mechanism 250 may comprise one or more springs (not shown) that pull one part 240 of the mounting mechanism 200 towards another part 260 of the mounting mechanism 200, thereby biasing inward facing surface 242 toward inward facing surface 262.

In some embodiments, these inward facing surfaces 242, 262 may be retractable while not in use so that the overall profile of the PCD holder 100 may be as small as possible when not in use to better fit in, for example, a pocket or purse. In some embodiments, the body member 300 also may be collapsible while not in use, such as, for instance, like a series of hoops that can flatten like a series of dominoes. By having a body member 300 that is collapsible and inward facing members 242, 262 that are collapsible, the overall profile of the holder 100 may be as small as possible when not in use so as to better fit in a pocket.

Figure 6:
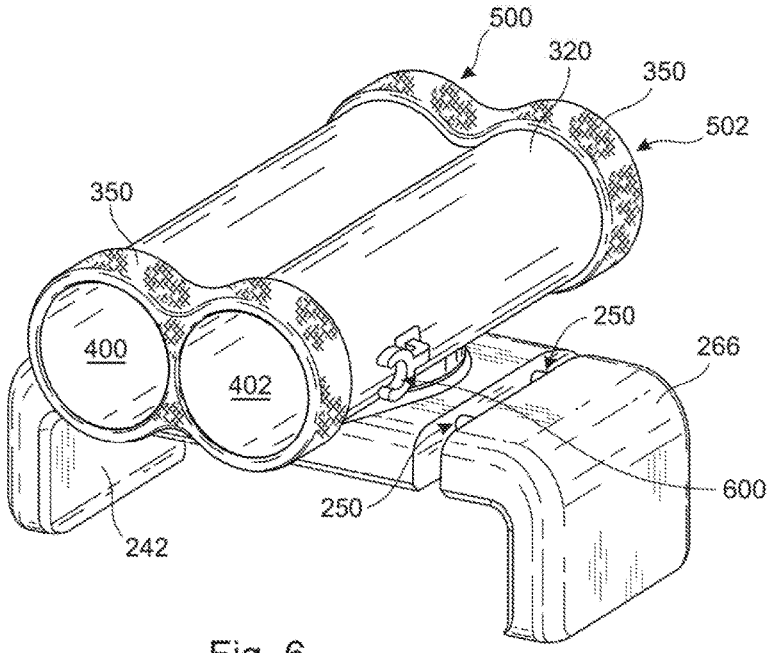
FIG. 6 is a perspective view of another embodiment of a PCD holder in keeping with the present invention in which the first and second finger-receiving recesses 400, 500 are accompanied by first and second finger-receiving recesses 402, 502 for the user's adjacent finger.

Also, in some embodiments, a fin (not shown), which itself may be retractable or foldable, extends from the body 300 in a direction generally away from the mounting mechanism 200 so that a large PCD may be propped up at desirable angles in a manner as discussed above. In some embodiments for large PCD, there are two first finger-receiving recesses 400, 402 (and possibly two second finger-receiving recesses 500, 502) as shown in FIG. 6 so that the large PCD can be securely held and controlled by two of the user's adjacent fingers rather than by just one finger. The two first finger-receiving recesses 400, 402 could be generally parallel, and the two recesses could be the same diameter, or one of these recesses could be of a smaller diameter to take into consideration that most adjacent fingers have two different diameters.

Also, embodiments that are configured for large PCDs may also have a second pair of inward facing surfaces, biased or otherwise, which may be generally perpendicular to the first pair of inward facing surfaces.

The method of providing the user with the option of either holding the PCD with a single finger or propping up the PCD on a flat surface is therefore described here. As a threshold question, the user decides whether he wants to hold the PCD or rest it on a generally flat surface. When the user wants to hold the PCD, he then decides where, vertically and horizontally, and at what angle he wants his holding finger so as to place the thumb of his same hand in an advantageous position in relation to the operating surface of the PCD.

The user then chooses where he wants either the first or the second finger-receiving recess 400 or 500, respectively. There are a number of configurations to select from. First, due to the fact that the axis of rotation C1 for the body member 300 is offset O1 to one side or the other from the centerline CL1 of the PCD, the user can change the configuration simply by flipping around the mounting mechanism 200. Second, since the first finger-receiving recess 400 is longer and thereby extends away from the axis of rotation C1 further than the second finger-receiving recess 500 does, the user can further change the configuration simply by rotating the body member 300 around the axis of rotation C1 by 180 degrees. That is, if the user wants his thumb closer to the touchscreen surface, he may rotate the holder 180 degrees so that the shorter, second finger-receiving recess 500 instead is in the desired position and orientation for the user's finger.

Third, the user can choose to insert his index, middle, ring, or pinky finger into the chosen finger-receiving recess, again, all to find the most comfortable PCD holding arrangement, which will most likely change from time to time, or to best position for the thumb on the same hand in relation to the touchscreen surface of the PCD. And, fourth, since the two opposing inward facing surfaces 242, 262 of the mounting mechanism 200 are parallel to each other, they can be mounted to almost any two generally parallel edges of the PCD and can then be slid up and down the two generally parallel edges of the PCD until the user arrives at the desired position of the chosen finger-receiving recess 400 or 500 for whatever the user wants to do with the PCD.

The user therefore chooses whether or not to flip the holder 100 around, mounts it onto the PCD in roughly the desired place for the desired location and orientation of the chosen finger-receiving recess, then chooses to use the longer, first finger-receiving recess 400 or rotate the body member 180 degrees to use the shorter, second finger-receiving recess 500, and chooses among his fingers to insert into the recess for the desired result, and then slides the mounted holder 100 up and down the PCD and tests whether his thumb (the thumb on the same hand as the selected holding finger) is optimally positioned to reach all of the touchscreen surface, or as much of the touchscreen surface as possible, with ease, preferably making accessible to his thumb at least all of the keyboard keys or other touch-sensitive input fields on the touchscreen surface.

For example, the user may want to slide the holder down the PCD and rotate the body member 100 to roughly 45 degrees from horizontal to get his or her thumb in just the right position to be the most proficient for data input on a virtual keyboard that happens to be displayed on the touchscreen surface of the PCD.

The user may then insert a finger from his other hand into the other finger-receiving recess to switch the PCD to the other hand, if for instance, the original holding hand gets tired or the user has to reach for something with the original holding hand. And then, the user can simply rotate the body member 90 degrees so as to keep the same orientation of the viewing screen of the PCD in relation to the user's eyes.

Or, the user may want to rotate the body member 300 to 90 degrees from horizontal to comfortably balance the PCD on his holding finger as he walks through a line in a coffee shop or carries a briefcase with his thumb and one or more of his free fingers on the same holding hand. These are just a few ways the combination of options allow for a variety of arrangements for mounting the holder 100 onto the back of the PCD in order to position the holder 100 so that the first finger-receiving recess 400 will be roughly where and in what angular orientation he wants.

One immediate benefit of the first finger-receiving 400 is that the user can securely hold the PCD with little effort and completely control and manipulate the PCD due to the rigid nature of the body member and the surfaces of the finger-receiving recess. As a result, the user can reach any part of the active touchscreen surface, and since user's finger is snugly fit into the finger receiving recess and since the recess and body member is rigid as is the rotatable connection between the body member and the mounting mechanism, the user can control the orientation of the PCD and thereby input information anywhere on the touchscreen surface with the thumb of the same hand as the finger with which he is holding the PCD, all the while securely holding the PCD with a single finger. Another immediate benefit of the first-finger receiving recess 400 is that the user can securely hold the PCD with the single finger, which is press-fit into the recess up to at least the first knuckle, and so carry and transport the PCD with ease, not having to consciously maintain a grip on the PCD the common and pervasive way, with both a thumb and finger using up both hand muscles as well as forearm muscles.

An immediate benefit of having a second finger-receiving recess 500 pointing in roughly the opposite direction as the first finger-receiving recess is that the user has twice as many combinations of placement options, vertically and horizontally. Another benefit of having a second finger-receiving recess 500 pointing in roughly the opposite direction as the first finger-receiving recess 400 is that the user can pass the holder from one hand to the next with ease, thereby switching hands, moving the PCD from one hand to the other, so that the user can use the newly freed hand for any given task, like reaching into a pocket for a wallet, car keys, or the like. That is, embodiments having two finger-receiving recesses provide the added benefit of allowing the user to easily move the holder, and thereby the PCD, from one hand to the other, such as if the user needs the one hand, for example, to sign a receipt or to shake someone's hand.

When, alternatively, the user wants to rest the PCD on a flat surface, he first determines whether he wants to rest the PCD in landscape or profile orientation and rotates the body member 300 perpendicular to the long dimension of the mounting mechanism 200 for landscape viewing or parallel to the long dimension of the mounting mechanism 200 for portrait viewing.

The user then decides what angle he wants for his screen. This will likely depend on the angle between the PCD and the user's eyes. He then mounts the holder to the PCD where he wants in order to achieve this angle. For profile viewing, the user can then slide the holder up or down to adjust this propping angle. For landscape viewing, the user can at least choose from a low angle and a higher angle. This is because the axis of rotation C1 for the rotatable connection between the body member 300 and the mounting mechanism 200 is offset a distance of O1 from the centerline CL1 of the PCD when mounted to the holder 100, as depicted in FIG. 4.

Indeed, in some embodiments, when holding the PCD with a single finger using the holder 100, the user may insert up to only the first or second knuckle of his holding finger into the finger-receiving recess 400. This allows the user to choose to place the rest of his holding hand, and thereby his thumb on this hand, a significant distance from the touchscreen surface. In many circumstances, this is best position for the thumb, freeing the thumb up to reach the most remote keys, input fields, or touch points on the touchscreen surface.

In some embodiments of the present invention, the finger-receiving recesses 400, 500 are rigid and in the form of roughly cylindrical tunnels and sized to snugly receive an average sized human finger, typically the middle finger or the ring finger up to the first knuckle or a little bit more. There may be a slight inward facing lip 422 at the end of one or both of the recesses, such as a slight inward-facing ridge or bulge so that the user's knuckle can do most of the work of holding the PCD without the other portions of the extremity of the user's finger being stuck in the recess. In some embodiments, there is a constriction or tapering 440 at or near the medial portion of the finger-receiving recesses. This would allow a single recess to successfully serve fingers of many different sizes and diameters in a snug press-fit fashion. Also, the recess could be cushioned and padded with a material that is substantially breathable to increase comfort for the user while he or she is holding the PCD with the one finger.

In some embodiments, the body member is rotatable 360 degrees, but with resistance between discrete angular positions so that the user may maintain a desired angular orientation of the finger-receiving recesses without effort. The end of the first recess 400 may be farther from the axis of rotation C1 than the end of the second recess 500. Also, the axis of rotation C1 itself may be offset from the centerline CL1 of the PCD when the holder 100 is mounted on the PCD, and the holder itself is removably, slideably, and reversibly attached to the PCD. As a result, the holder allows many different holding angles to choose from when holding the PCD with a finger. This, in turn, allows for many different placements to choose from for positing the user's thumb over the touchscreen surface of the PCD. Also, as a result, the holder allows for a number of different screen angles to choose from when setting the PCD and holder down on a flat surface, either in landscape or portrait orientation, to optimize hands-free viewing of the screen. Furthermore, by being removably attachable to the PCD, the mounting mechanism 200 does not require the user to permanently affix the holder 100 to the PCD or otherwise to alter the PCD itself.

In some embodiments, the connection between the body member and the mounting mechanism is magnetic—that is, where one of the two members comprises a strong magnetic pull, such as a neodymium magnet, or the like, and the other comprises a steel or other metal surface suitable for reacting favorably to the magnetic pull. The magnetic attraction is designed to be strong enough to avoid the chance that the two members would get separated unintentionally, but such that the two may be easily separated if the user pulls on the body member hard enough, possibly with a slight angular motion to aid in the removal. In some such embodiments, a portion of the outer surface of the body member is generally cylindrical and a portion of the mounting mechanism comprises a cylindrical indentation configured to mate with the cylindrical portion of the outer surface of the body member.

Alternatively, in some such embodiment, the interface between the body member and the mounting mechanism may comprise a conical surface (or truncated conical surface) on one member and a mating conical recess on the surface of the other. In other such embodiments, the interface is more generally spherical. In some such embodiments, the two mating surfaces may further comprise mating saw-toothed surface structures that divide the circumference of the interface into 36, 72, or the like teeth, for example, to give the user several discrete positions in which to place the body member relative to the mounting mechanism.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A method of securely holding and controlling a PCD with just a portion of a single finger of a user's hand up to the first or second knuckle so that the thumb of the same hand can reach all parts of a touch sensitive surface of the PCD, comprising:

removably mounting a holding device to the PCD, repeatedly removing and remounting said holding device to said PCD over and over again, the holding device having a body portion that is rotatable relative to the PCD about an axis that is generally perpendicular to a plane defined by a touchscreen display of the PCD when the holding device is mounted to the PCD but that resists rotation enough to require the user to apply an angular force to the body portion in order to rotate the body portion around said axis, the body portion having at least first and second finger-receiving recesses, selecting an angular orientation for the first finger-receiving recess among a plurality of available angular orientations by rotating the body portion around said axis, said first and second finger-receiving recesses each configured to snugly and securely receive a user's finger in press-fit manner up to the first or second knuckle of the finger so that the user can securely hold and control the PCD with a single finger, and at least said first finger-receiving recess having an opening and a radially inward protruding lip substantially encircling said opening, securely holding and controlling said PCD by pressing a first finger into the first finger-receiving recess up to the first knuckle of said first finger, reaching and accessing all parts of a touch sensitive surface of the PCD with the thumb of said hand, removing said first finger from the first finger-receiving recess and pressing a second finger into the second finger-receiving recess up to a first or second knuckle of said second finger, wherein the second finger-receiving recess is shorter than the first finger-receiving recess as measured from the axis of rotation of the body portion to a distal end of each respective finger-receiving recess and is oriented in a generally opposite direction as the first finger-receiving recess and connected thereto forming a single, generally cylindrical recess wall and to allow the user the option of easily passing the holder from a finger on one hand to a finger on the user's opposite hand when the user has to use the first hand for something other than holding the PCD, removing the holding device from the PCD, reversing the holding device and remounting the holding device to the PCD to provide the user with a number of positions for the finger-receiving recesses, said body portion also having a rigid first outward facing support surface and said holding device having second and third outward facing support surfaces on opposite sides of said first outward facing support surface, said first and second outward facing support surfaces configured to prop up the PCD in a first orientation when the holder is set on a generally flat surface, and said first and third outward facing support surfaces configured to prop up the PCD in a second orientation when the holder is set on a generally flat surface, propping up said PCD in either the first or second orientation by setting the holding device on a generally flat surface.

2. The method of claim 1, wherein the removably mounting step comprises:

a mounting mechanism for mounting the holder to a PCD, said mounting mechanism being connected to the rotatable body at a connection point on the mounting mechanism that is offset from a center point of the mounting mechanism when the mounting mechanism is mounted to the PCD, the rotatable body having an axis of rotation at the connection point.

3. The method of claim 2, wherein the mounting mechanism is reversible when mounting the holding device to the PCD to provide the user with a number of positions for the holder.

4. The method of claim 1, further comprising one or more tactile regions on the first, second, and third outward facing support surfaces to make the holder resistant to sliding around on the flat surface.

5. The method of claim 1, further comprising a constriction within at least one of said first and second finger-receiving recesses to make the recess configured to snugly receive in a press-fit manner a range of finger diameters.

6. The method of claim 1 further comprising a cushion and breathable surface covering surfaces of the first finger-receiving recess.

7. The method of claim 1 further comprising a holding mechanism for holding a wireless earpiece or other accessory.

8. The method of claim 1, wherein the mounting mechanism is connected to the rotatable body by magnetic force sufficient to avoid an unintended disconnection between the two.

9. A method of securely holding and controlling a PCD with just a portion of a single finger of a user's hand up to the first or second knuckle so that the thumb of the same hand can reach all parts of a touch sensitive surface of the PCD, comprising:

removably mounting a holding device to the PCD, repeatedly removing said holding device from said PCD, reversing said holding device, and remounting said holding device to said PCD over and over again to provide the user with a number of positions for holding the device, the holding device having a body portion that is rotatable relative to the PCD about an axis that is generally perpendicular to a plane defined by a touch-screen display of the PCD when the holding device is mounted to the PCD but that resists rotation enough to require the user to apply an angular force to the body portion in order to rotate the body portion around said axis, the body portion having a first finger-receiving recess and a second finger-receiving recess, said second finger-receiving recess configured to snugly and securely receive a user's finger in press-fit manner up to the first or second knuckle of the finger so that the user can securely hold and control the PCD with a single finger to allow the user the option of easily passing the holder from a finger on one hand to a finger on the user's opposite hand when the user has to use the first hand for something other than holding the PCD, wherein the second finger-receiving recess is oriented in a generally opposite direction as the first finger-receiving recess and is shorter than the first finger-receiving recess as measured from the axis of rotation of the body portion to a distal end of each respective finger-receiving recess, wherein at least one of said first and second finger-receiving recesses has a constriction to make the constricted recess configured to snugly receive a range of finger diameters in a press-fit manner, selecting a first angular orientation for the first finger-receiving recess among a plurality of available angular orientations by rotating the body portion around said axis, said first finger-receiving recess configured to snugly and securely receive a user's finger in press-fit manner up to the first or second knuckle of the finger so that the user can securely hold and control the PCD with a single finger, securely holding and controlling said PCD by pressing a first finger into the first finger-receiving recess up to the first knuckle of said first finger, reaching and accessing all parts of a touch sensitive surface of the PCD with the thumb of said hand, said body portion also having a rigid first outward facing support surface, said first outward facing support surface configured to prop up the PCD in a first orientation when the holder is set on a generally flat surface, and configured to prop up the PCD in a second orientation when the holder is rotated 90° and then set on a generally flat surface, propping up said PCD in either the first or second orientation by setting the holding device on a generally flat surface.

10. The method of claim 9, wherein said first finger-receiving recess further comprising an opening and a radially inward protruding lip substantially encircling said opening to secure the fit of the finger-receiving recess around a knuckle of said finger and still afford the user full control of the PCD.

11. The method of claim 9, further comprising:

removing said first finger from the first finger-receiving recess and pressing a second finger into the second finger-receiving recess up to a first or second knuckle of said second finger.

12. The method of claim 9, wherein the second finger-receiving recess is oriented in a generally opposite direction as the first finger-receiving recess and connected thereto forming a single, generally cylindrical recess wall.

13. The method of claim 9, wherein said holding device having second and third outward facing support surfaces on opposite sides of said first outward facing support surface, said first and second outward facing support surfaces configured to prop up the PCD in a first orientation when the holder is set on a generally flat surface, and said first and third outward facing support surfaces configured to prop up the PCD in a second orientation when the holder is set on a generally flat surface, said method further comprising propping up said PCD in either the first or second orientation by setting the holding device on a generally flat surface.

14. A method for allowing a user to choose between easily and securely holding a personal computing device (PCD), on the one hand, and selecting from a number of viewing angles when setting the PCD on a flat surface, on the other hand, the method comprising:

providing a body member comprising a first finger-receiving recess having an opening shaped and sized to receive a finger of a user in a press-fit fashion so that the user can easily hold and manipulate the PCD with just a single finger up to a first or second knuckle thereof, a second finger-receiving recess shorter than the first finger-receiving recess as measured from the axis of rotation of the rotatably connected body and a distal end of the respective finger-receiving recesses, wherein the first and second finger-receiving recesses are connected and form a single, generally cylindrical recess wall, wherein at least one of said first and second finger-receiving recesses has a constriction to make the constricted recess configured to snugly receive a range of finger diameters in a press-fit manner, and at least one rigid outward facing support surface configured to support a PCD when the body member is set on a generally flat surface, providing a mounting mechanism rotatably connected to the body member and configured to selectively and removably mount the body member to the PCD, and providing second and third outward facing support surfaces connected to the mounting mechanism on opposite sides of said first outward facing support surface, said first and second outward facing support surfaces being configured to prop up the holder and PCD in a first orientation when the holder is set on a generally flat surface, and said first and third outward facing support surfaces configured to prop up the PCD in a second orientation when the holder is set on a generally flat surface, removably mounting a holding device to the PCD, removing said holding device from said PCD, reversing said holding device, and remounting said holding device to said PCD to provide the user with a number of positions for holding the device, holding and manipulating the PCD with just a single finger up to a first or second knuckle thereof, reaching and accessing all parts of a touch sensitive surface of the PCD with the thumb of said hand, and propping up said PCD in either the first or second orientation by setting the holding device on a generally flat surface.

* * * * *